US006972740B2

(12) United States Patent
Lee et al.

(10) Patent No.: US 6,972,740 B2
(45) Date of Patent: Dec. 6, 2005

(54) PLASMA DISPLAY PANEL METHOD AND APPARATUS FOR PREVENTING AFTER-IMAGE ON THE PLASMA DISPLAY PANEL

(75) Inventors: Soo-Jin Lee, Cheonan (KR); Woo-Jin Kim, Asan (KR); Im-Su Choi, Yangsan (KR)

(73) Assignee: Samsung SDI Co., Ltd., Suwon (KR)

( * ) Notice: Subject to any disclaimer, the term of this patent is extended or adjusted under 35 U.S.C. 154(b) by 366 days.

(21) Appl. No.: 10/425,541

(22) Filed: Apr. 28, 2003

(65) Prior Publication Data

US 2003/0231146 A1 Dec. 18, 2003

(30) Foreign Application Priority Data

Jun. 14, 2002 (KR) ..... 10-2002-0033202

(51) Int. Cl.[7] ..... G09G 3/28
(52) U.S. Cl. ..... 345/60; 345/214
(58) Field of Search ..... 345/60, 63, 84, 345/212, 214; 359/101, 161; 348/168, 208, 348/699; 382/1

(56) References Cited

U.S. PATENT DOCUMENTS

| | | | | |
|---|---|---|---|---|
| 5,748,231 | A * | 5/1998 | Park et al. | 348/207.99 |
| 2001/0024307 | A1 * | 9/2001 | Franco et al. | 359/161 |
| 2003/0146975 | A1 * | 8/2003 | Joung et al. | 348/164 |
| 2004/0021621 | A1 * | 2/2004 | Kim et al. | 345/60 |

* cited by examiner

*Primary Examiner*—Amare Mengistu
(74) *Attorney, Agent, or Firm*—Christie, Parker and Hale, LLP

(57) ABSTRACT

An after-image prevention apparatus and method for a plasma display panel having a plurality of address electrodes and a plurality of scan and sustain electrodes arranged in pairs and in a zigzag pattern. An average signal level until the current frame from currently input picture data and an average signal level of each cell until the previous frame as stored in a memory section is calculated. The average signal level is compared with the picture data. An attenuation coefficient is generated corresponding to the difference between the average signal level and the picture data. The picture data is multiplied by the attenuation coefficient to output correction data, thereby preventing an after-image phenomenon on the plasma display panel.

20 Claims, 4 Drawing Sheets

PLASMA DISPLAY PANEL METHOD AND APPARATUS FOR PREVENTING AFTER-IMAGE ON THE PLASMA DISPLAY PANEL

CROSS REFERENCE TO RELATED APPLICATION

This application claims priority to and the benefit of Korean Patent Application No. 2002-0033202 filed on Jun. 14, 2002 in the Korean Intellectual Property Office, the content of which is incorporated herein by reference.

BACKGROUND OF THE INVENTION (a) Field of the Invention

The present invention relates to a plasma display panel apparatus. More specifically, the present invention relates to an after-image prevention apparatus and method for a plasma display panel, and a plasma display panel apparatus including the after-image prevention apparatus.

(b) Description of the Related Art

In general, displaying a bright picture for an extended period can make a brightness difference between display and non-display areas on a plasma display panel due to degradation of the fluorescent material, and it can cause an after-image to remain on the screen, as in a cathode ray tube.

To prevent the after-image phenomenon, the conventional methods separate a still picture from a moving picture, and for a long-term display of the still picture, invert the image or lower the brightness of the screen. These methods are, however, problematic in that the screen appears different or the image appears immersed in a dark screen.

Another conventional method involves calculating an average signal level by frames for frame-based brightness control. This method requires expensive frame memories and displays only pixels of a defined area with a high brightness for an extended period, causing an after-image phenomenon or degradation.

SUMMARY OF THE INVENTION

In accordance with the present invention an after-image prevention apparatus and method for a plasma display panel is provided. The plasma display panel apparatus has an after-image prevention apparatus that prevents an after-image remaining on a plasma display panel when the plasma display panel apparatus displays a still picture for an extended period, or data of a specific area of a moving picture with a high brightness for an extended period.

In one aspect of the present invention, there is provided an after-image prevention method for a plasma display panel that is to prevent an after-image on the plasma display panel including a plurality of address electrodes and a plurality of scan and sustain electrodes arranged in pairs and in a zigzag pattern. An average signal level of each cell is calculated until the current frame from currently input picture data, and an average signal level of each cell until the previous frame as stored in a memory section. The calculated average signal level is compared with the picture data to determine the difference between the average signal level and the picture data. An attenuation coefficient corresponding to the difference is output. The picture data is multiplied by the attenuation coefficient to output correction data.

In another aspect of the present invention, there is provided an after-image prevention apparatus for a plasma display panel that is to prevent an after-image on the plasma display panel having a plurality of address electrodes and a plurality of scan and sustain electrodes arranged in pairs and in a zigzag pattern. The apparatus includes a memory section for storing an average signal level of each cell of the plasma display panel. An average signal level calculator calculates a current average signal level from externally applied picture data, and an average signal level of each cell until the previous frame as stored the memory section. A comparator compares the picture data with the average signal level of each cell output from the average signal level calculator to determine the difference between the picture data and the average signal level, and outputs an attenuation coefficient corresponding to the difference. A multiplier multiplies the picture data by the attenuation coefficient.

In another aspect of the present invention, there is provided a plasma display panel apparatus having a plasma display panel having a plurality of address electrodes and a plurality of scan and sustain electrodes arranged in pairs and in a zigzag pattern. A controller processes an externally applied picture signal to output picture data, measures a load factor of the picture signal, and outputs sustain discharge information corresponding to the measured load factor. An after-image prevention controller calculates an average signal level of each cell until the current frame from the picture data output from the controller, and an average signal level until the previous frame, comparing the calculated average signal level with the picture data, and multiplying the picture data by an attenuation coefficient corresponding to the difference between the average signal level and the picture data to output correction data. An address data generator generates address data corresponding to the correction data and applies the generated address data to the address electrodes of the plasma display panel. A sustain/scan pulse generator generates sustain and scan pulses corresponding to the sustain discharge information output from the controller and applies the generated sustain and scan pulses to the sustain and scan electrodes, respectively.

DETAILED DESCRIPTION OF THE PREFERRED EMBODIMENTS

Figure 1:
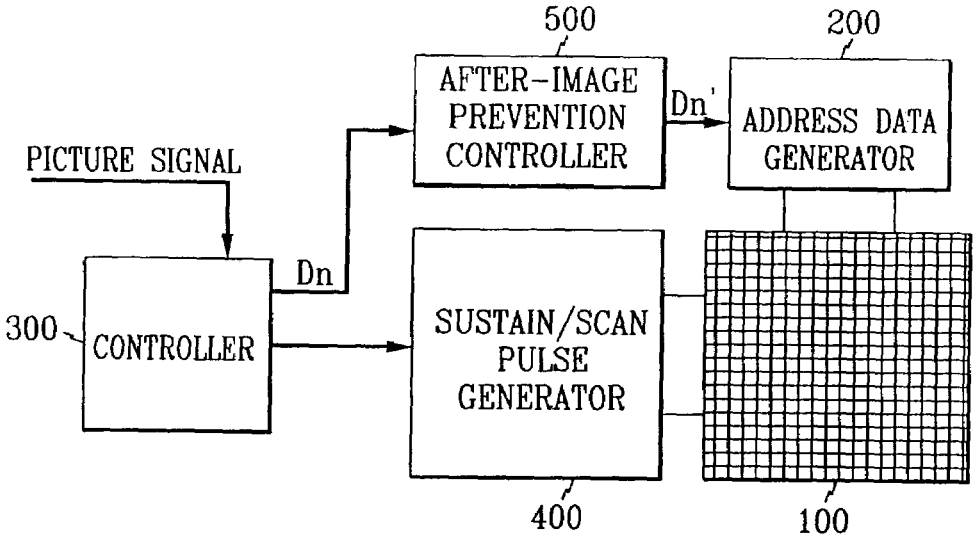
FIG. 1 is a schematic of a plasma display panel apparatus in accordance with an embodiment of the present invention.

FIG. 1 is a schematic of a plasma display panel apparatus according to an embodiment of the present invention.

Referring to FIG. 1, the plasma display panel apparatus according to the embodiment of the present invention includes plasma display panel 100, controller 300, address data generator 200, sustain/scan pulse generator 400, and after-image prevention controller 500. Plasma display panel 100 includes a plurality of address electrodes and a plurality of scan and sustain electrodes arranged in pairs and in a zigzag pattern. Controller 300 performs gamma correction and image processing of an externally applied picture signal, measures a load factor of the picture signal, and generates sustain discharge information corresponding to the measured load factor. After-image prevention controller 500 calculates an average signal level of each pixel until the current frame from the picture data output from controller 300, and an average signal level until the previous frame, compares the calculated average signal level with the picture data, and multiplies the picture data by an attenuation coefficient corresponding to the difference between the average signal level and the picture data, to output correction data. Address data generator 200 generates address data corresponding to the correction data of after-image prevention controller 500, and applies them to the address electrodes of plasma display panel 100. Sustain/scan pulse generator 400 generates sustain and scan pulses corresponding to the sustain discharge information of controller 300, and applies them to the sustain and scan electrodes, respectively.

Figure 2:
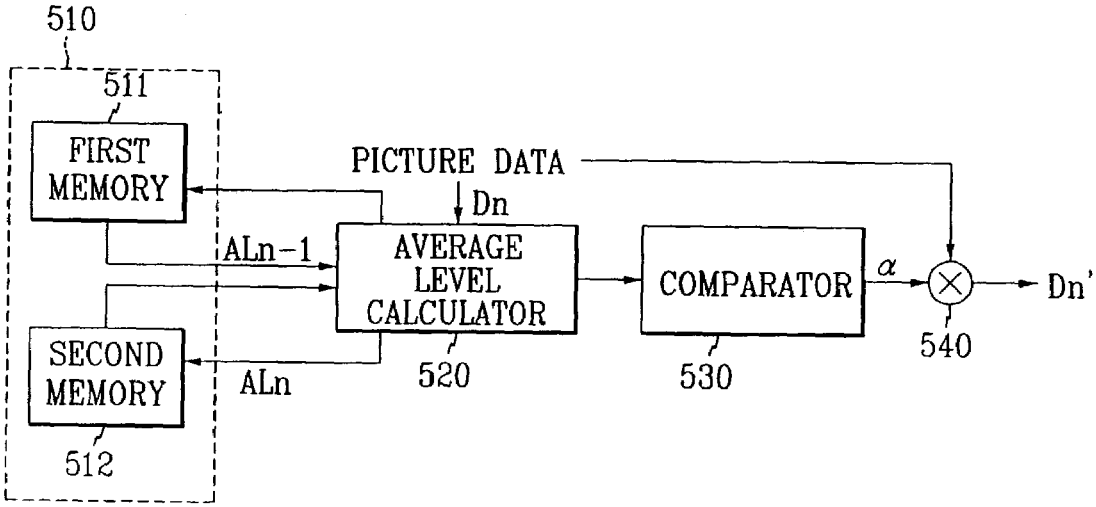
FIG. 2 is a schematic of an after-image prevention apparatus for a plasma display panel in accordance with a first embodiment of the present invention.

FIG. 2 is a schematic of the after-image prevention apparatus according to a first embodiment of the present invention, in which the inner construction of after-image prevention controller 500 of FIG. 1 is illustrated. Referring to FIG. 2, after-image prevention controller 500 includes memory section 510, average signal level calculator 520, comparator 530, and multiplier 540. Memory section 510 stores the average signal levels of the respective cells of the plasma display panel apparatus. Average signal level calculator 520 calculates an average signal level of each pixel until the current frame from externally applied picture data and an average signal level of each pixel until the previous frame as stored in the memory section. Comparator 530 compares the picture data with the average signal level of each pixel output from average signal level calculator 520 to calculate the difference between the picture data and the average signal level and outputs an attenuation coefficient corresponding to the difference. Multiplier 540 multiplies the picture data by the attenuation coefficient.

Now, a detailed description will be given as to the operation of the after-image prevention apparatus and method for a plasma display panel, and to a plasma display panel apparatus having the after-image prevention apparatus according to the first embodiment of the present invention.

First, an externally applied picture signal including R, G, and B components is fed into controller 300.

Controller 300 performs gamma correction and image processing on the picture signal, and measures the load factor of the R, G, and B components. Then controller 300 generates sustain discharge pulse information corresponding to the measured load factor.

On receiving the sustain discharge information, sustain/scan pulse generator 400 generates sustain and scan pulses corresponding to the load factor and applies them to the sustain and scan electrodes, respectively.

After-image prevention controller 500 receives image-processed picture data $D_n$ from controller 300 and performs after-image prevention control, which will now be described.

The average signal level calculator 520 reads out average signal level $Al_{n-1}$ of each cell until the previous frame from first memory 511 and operates them with each cell of input picture data $D_n$ to calculate average signal level $AL_n$ of each cell until the current frame, according to the following equation:

$$AL_n=\beta D_n+\gamma AL_{n-1} \quad \text{Equation 1}$$

where β and γ are variable and are given by the following equation, in the embodiment of the present invention:

$$AL_n=(1/N)D_n+((N-1)/N)AL_{n-1} \quad \text{Equation 2}$$

Figure 3:
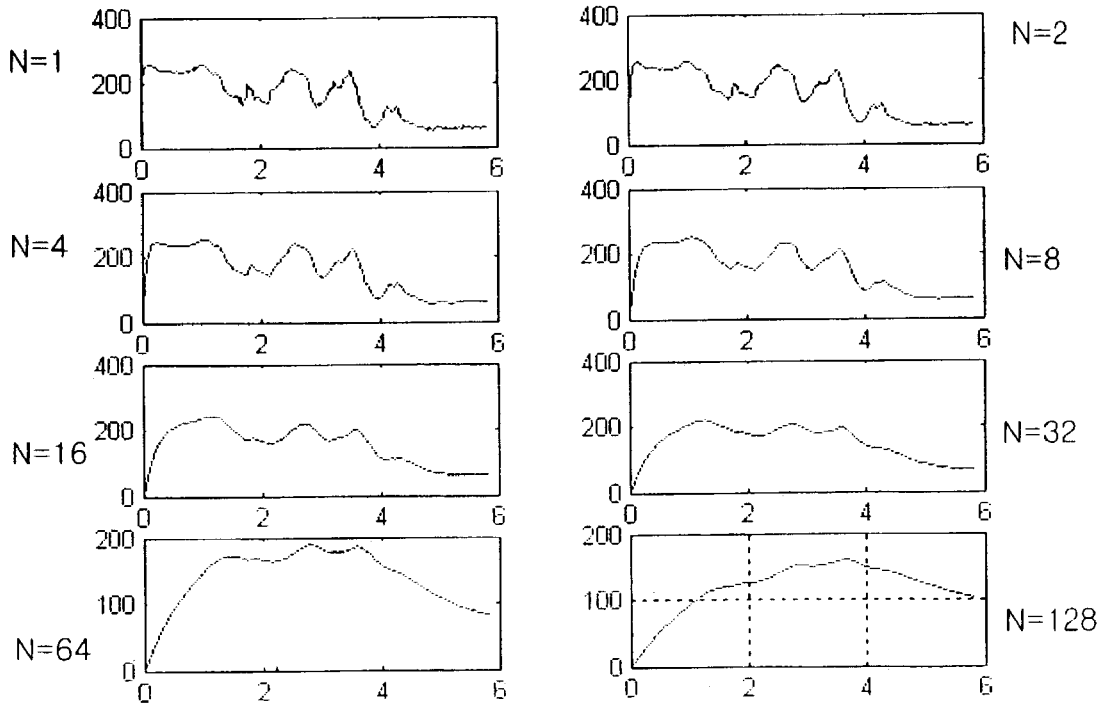
FIG. 3 illustrates an average signal level according to the number of samples.

Referring to FIG. 3, when the number of samples N is excessively small, the average signal level sensitively varies with respect to the picture data; otherwise, when the number of samples N is excessively large, the average signal level changes little so it is difficult to determine. Preferably, the number of samples N is $2^m$ (m is zero or a natural number) in consideration of the processing speed.

By using Equation 2, it is only necessary to use line memories 511 and 512 having small capacities instead of a frame memory having a large capacity, thereby reducing the required memory capacity and increasing the processing speed. In the early stage, a time period is needed to approach the average signal level, during which comparator 530 outputs the attenuation coefficient α as "1".

Subsequently, average signal level calculator 520 stores the calculated average signal level in second memory 512. Here, memory section 510 includes first and second memories 511 and 512, which operate alternately. For example, when first memory 511 is in the read mode for the n-th frame, second memory 512 is in the write mode; and when first memory 511 is in the write mode for the (n+1)-th frame, second memory 512 is in the read mode.

Once average signal level $AL_n$ is calculated, comparator 530 compares picture data $D_n$ with average signal level $AL_n$ to calculate the difference between the picture data and the average signal value and outputs attenuation coefficient α according to the difference. Attenuation coefficient α is determined as follows.

Comparator 530 stores reference average signal level $AL_{MAX}$ that represents a possible appearance of an after-image phenomenon, and which is determined by an experiment carried out beforehand.

Comparator 530 checks whether or not input average signal level $AL_n$ is greater than reference average signal level $AL_{MAX}$. When average signal level $AL_n$ is less than reference average signal level $AL_{MAX}$, comparator 530 outputs attenuation coefficient α as "1"; otherwise, when average signal level $AL_n$ is not less than reference average signal level $AL_{MAX}$, comparator 530 compares average signal level $AL_n$ with picture data $D_n$.

When the brightness level of picture data $D_n$ is less than average signal level $AL_n$, comparator 530 outputs attenuation coefficient α as "1".

When the brightness level of picture data $D_n$ is greater than average signal level $AL_n$, comparator 530 outputs attenuation coefficient α as a value of less than 1 and that is inversely proportional to the difference between the brightness level of picture data $D_n$ and average signal level $AL_n$. Namely, attenuation coefficient α has a value of less than 1, said value decreasing with an increase in the difference between the brightness level of picture data $D_n$ and average signal level $AL_n$. Attenuation coefficient α may be changed in its variations and it may be defined in a predetermined range.

Once attenuation coefficient α is determined, multiplier 540 multiplies picture data $D_n$, by attenuation coefficient α and outputs correction data $D_n'$.

Address data generator 200 generates address data corresponding to correction data $D_n'$ output from multiplier 540 of after-image prevention controller 500, then plasma display panel 100 displays the picture data.

The above procedures are performed for all pixels, so that the user can see the screen displayed without an after-image phenomenon.

But there are some cases where the after-image phenomenon is actually problematic only in a certain part of information constituting a screen. Accordingly, after-image prevention control only for the certain part of the screen is very desirable in the aspect of the processing speed, which will be described by way of a second embodiment as follows.

Figure 4:
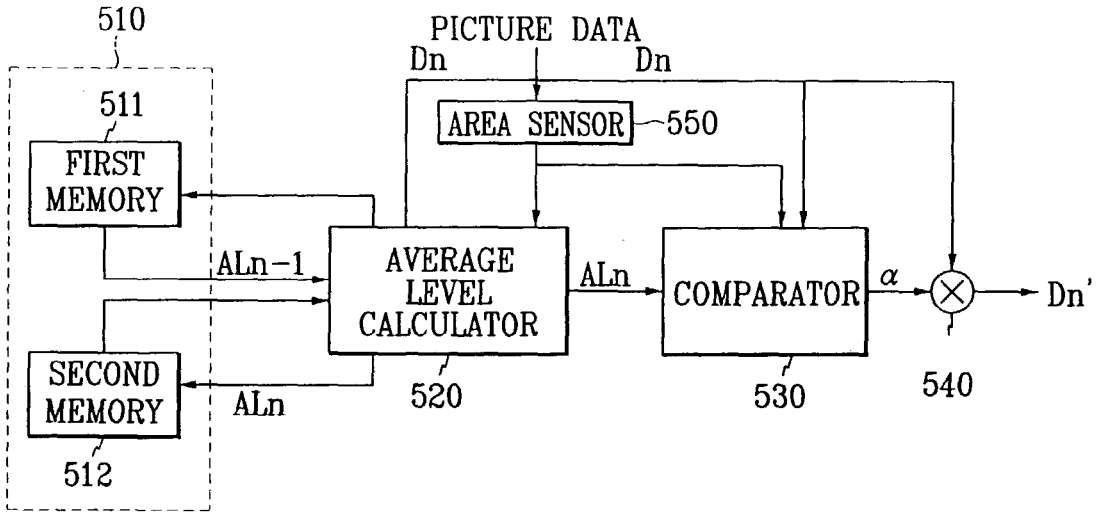
FIG. 4 is a schematic of an after-image prevention apparatus for a plasma display panel in accordance with a second embodiment of the present invention.

FIG. 4 is a schematic of an after-image prevention apparatus for a plasma display panel in accordance with the second embodiment of the present invention.

Figure 5A:
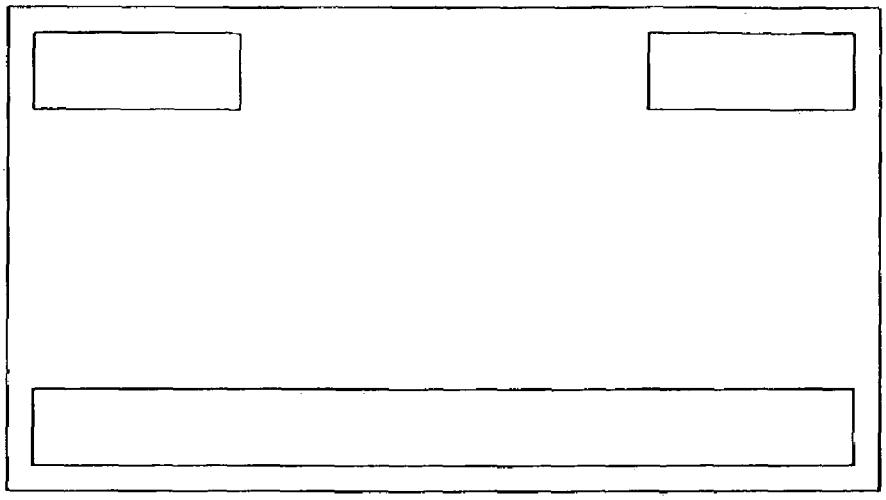
FIG. 5*a* is a diagram showing an example of an area defined in the after-image prevention apparatus for a plasma display panel according to the second embodiment of the present invention.

FIG. 5*a* is a diagram showing an example of an area defined in the after-image prevention apparatus for a plasma display panel according to the second embodiment of the present invention.

Figure 5B:
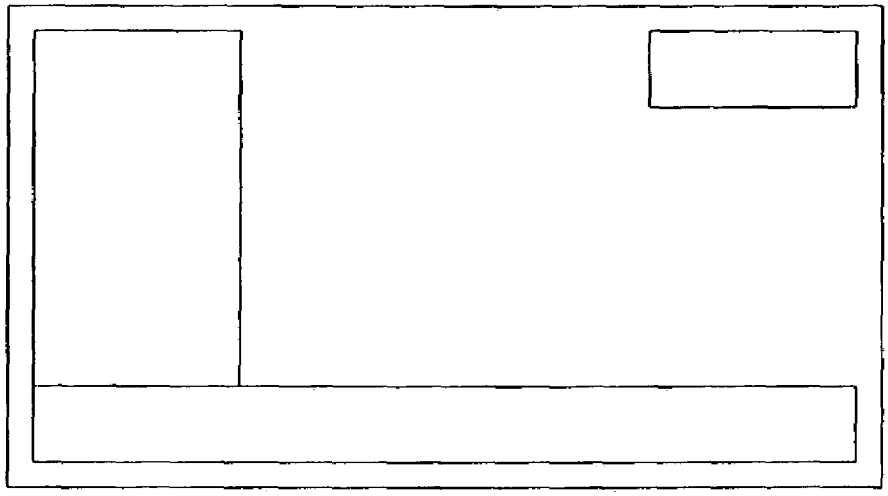
FIG. 5*b* is a diagram showing another example of an area defined in the after-image prevention apparatus for a plasma display panel according to the second embodiment of the present invention.

FIG. 5*b* is a diagram showing another example of an area defined in to the after-image prevention apparatus for a plasma display panel according to the second embodiment of the present invention.

The second embodiment is different in the construction of after-image prevention controller 500 from the first embodiment. The same numerals are assigned to the same components, and a different numeral is assigned only to the additional component.

Referring to FIG. 4, the after-image prevention apparatus for a plasma display panel according to the second embodiment of the present invention includes area sensor 550, memory section 510, average signal level calculator 520, comparator 530 and multiplier 540. Area sensor 550 senses the area of picture data $D_n$ and determines whether or not the picture data area is an area predefined for after-image control. Memory section 510 stores the average signal level of each cell of the plasma display panel apparatus. Average signal level calculator 520 calculates the current average signal level from picture data $D_n$ and the average signal level until the previous frame as stored in memory section 510, when picture data $D_n$ belongs to the after-image control area. In such a case where picture data $D_n$ is included in the after-image control area, comparator 530 compares the picture data with the average signal level of each cell output from average signal level calculator 520 to calculate the difference between the picture data and the average signal level and generates an attenuation coefficient corresponding to the calculated difference. When picture data $D_n$ is not included in the after-image control area, comparator 530 outputs attenuation coefficient $\alpha$ of "1". Multiplier 540 multiplies the picture data by attenuation coefficient $\alpha$.

Now, a detailed description will be given as to the operation of the after-image prevention apparatus and method for a plasma display panel, and a plasma display panel apparatus having the after-image prevention apparatus according to the second embodiment of the present invention. The same components as in the first embodiment will not be described in detail.

First, upon receiving externally applied picture data, controller 300 performs image processing on the picture data, measures the load factor, and generates sustain discharge pulse information corresponding to the measured load factor.

Sustain/scan pulse generator 400 receives the sustain discharge information, generates sustain and scan pulses corresponding to the load factor and applies the generated sustain and scan pulses to the sustain and scan electrodes, respectively.

After-image prevention controller 500 receives picture data $D_n$ image-processed by controller 300, and performs after-image prevention control, which will now be described.

Area sensor 550 senses a predefined area of picture data $D_n$ to generate an area sensing signal. The area is predicted or predefined by an experiment as illustrated in FIGS. 5*a* and 5*b*.

Average level calculator 520 calculates only average signal level $AL_n$ of the defined area, excluding the non-defined area, according to the area sensing signal.

On receiving the area sensing signal, comparator 530 outputs attenuation coefficient $\alpha$ as "1" for the non-defined area. For the defined area, comparator 530 compares picture data $D_n$ with average signal level $AL_n$ to calculate the difference between the picture data and the average signal level, and outputs attenuation coefficient $\alpha$ according to the difference. The procedures of determining attenuation coefficient $\alpha$ are performed in the same manner as described in the first embodiment.

Once attenuation coefficient $\alpha$ is determined, multiplier 540 multiplies picture data $D_n$ by attenuation coefficient $\alpha$ to output correction data $D_n'$. Address data generator 200 generates address data corresponding to correction data $D_n'$ and applies the generated address data to the address electrode lines. The picture data is then displayed on a specific area of plasma display panel 100 without an after-image phenomenon.

The second embodiment is advantageous in after-image prevention on a specific area of the screen, and it is especially preferable for use in a specific pattern such as displaying the time or a phrase on a specific area of the screen.

Such after-image prevention control can be realized with the area sensor and the comparator without the average signal level calculator, which will be described by way of a third embodiment as follows.

The area sensing signal output from area sensor 550 is fed into the comparator, which outputs an attenuation coefficient that is "1" for a non-predefined area and a predetermined value for the predefined area. After a lapse of a predetermined time period, the after-image control is not performed. Additionally, after another lapse of the predetermined time period, the after-image control is resumed.

The third embodiment of the present invention can be readily realized by those skilled in the art and will not be described further with reference to the drawings.

While this invention has been described in connection with what is presently considered to be the most practical embodiment, it is to be understood that the invention is not limited to the disclosed embodiments, but, on the contrary, is intended to cover various modifications and equivalent arrangements included within the spirit and scope of the appended claims.

As described above, the embodiment of the present invention lowers the brightness of an input still image of a high brightness that is greater than a predetermined level without performing after-image control on the dark screen and performs after-image prevention control on a specific interval of a moving picture that is susceptible to the after-image phenomenon, thereby preventing an after-image from remaining on the plasma display panel to increase the use life of the plasma display panel.

Furthermore, the present invention calculates the average signal level and compares the data of each pixel for all frames, thereby readily determining whether the picture data is a still picture or a moving picture.

What is claimed is:

1. An after-image prevention method for a plasma display panel, said method to prevent an after-image on the plasma display panel having a plurality of address electrodes and a plurality of scan and sustain electrodes arranged in pairs and in a zigzag pattern, the method comprising:

(a) calculating an average signal level of each cell until the current frame from currently input picture data and an average signal level of each cell until the previous frame as stored in a memory section;

(b) comparing the calculated average signal level with the picture data to determine the difference between the average signal level and the picture data, and outputting an attenuation coefficient corresponding to the difference; and (c) multiplying the picture data by the attenuation coefficient to output correction data.

2. The after-image prevention method as claimed in claim 1, further comprising:

outputting the attenuation coefficient as "1" when the picture data do not belong to an after-image control area.

3. The after-image prevention method as claimed in claim 1, wherein the average signal level is calculated by the following equation:

$$AL_n=\beta D_n+\gamma AL_{n-1}$$

wherein ALis the current average signal level; $D_n$ is the picture data; $AL_{n-1}$is the average signal level until the previous frame; and β and γ are coefficients.

4. The after-image prevention method as claimed in claim 1, wherein the average signal level is calculated by the following equation:

$$AL_n=D_n/N-AL_{n-1}/N+AL_{n-1}$$

wherein N is the number of samples; $AL_n$ is the current average signal level; $D_n$ is the picture data; and $AL_{n-1}$ is the average signal level until the previous frame.

5. The after-image prevention method as claimed in claim 1, wherein the calculating includes calculating the average signal level of each cell while alternately reading and writing data from and to first and second memories of the memory section whenever the frame changes.

6. The after-image prevention method as claimed in claim 5, wherein the attenuation coefficient is "1" when the current average signal level is less than a minimum average signal level that is a reference value representing a possible appearance of the after-image, thereby not attenuating the picture data.

7. The after-image prevention method as claimed in claim 6, wherein the attenuation coefficient is "1" when a brightness level of the picture data is less than the current average signal level, and wherein the attenuation coefficient is less than "1" when the brightness level of the picture data is greater than the current average signal level, the attenuation coefficient decreasing with an increase in the difference between the average signal level and the brightness level of the picture data.

8. The after-image prevention method as claimed in claim 7, wherein the minimum average signal level is a reference brightness level representing a possible appearance of the after-image, the minimum average signal level being predetermined by an experiment.

9. An after-image prevention method for a plasma display panel, said method to prevent an after-image on the plasma display panel having a plurality of address electrodes and a plurality of scan and sustain electrodes arranged in pairs and in a zigzag pattern, the method comprising:

(a) sensing an area of externally applied picture data and determining whether or not the picture data area is an area predefined for after-image control;

(b) calculating an average signal level of each cell until the current frame from the input picture data and an average signal level of each cell until the previous frame as stored in a memory section, when the picture data area is included in the after-image control area;

(c) comparing the picture data with an average signal level calculated to determine the difference between the picture data and the average signal level, and outputting an attenuation coefficient corresponding to the difference; and (d) multiplying the picture data by the attenuation coefficient to output correction data.

10. An after-image prevention apparatus for a plasma display panel, said apparatus to prevent an after-image on the plasma display panel having a plurality of address electrodes and a plurality of scan and sustain electrodes arranged in pairs and in a zigzag pattern, the apparatus comprising:

a memory section for storing an average signal level of each cell of the plasma display panel;

an average signal level calculator for calculating a current average signal level from externally applied picture data and an average signal level of each cell until the previous frame as stored in the memory section;

a comparator for comparing the picture data with the average signal level of each cell output from the average signal level calculator to determine the difference between the picture data and the average signal level and outputting an attenuation coefficient corresponding to the difference; and a multiplier for multiplying the picture data by the attenuation coefficient.

11. The after-image prevention apparatus as claimed in claim 10, wherein the memory section includes first and second memories, the memory section alternately reading and writing data from and to the first and second memories whenever the frame changes.

12. The after-image prevention apparatus as claimed in claim 10, wherein the comparator outputs the attenuation coefficient as "1" when the current average signal level is less than a minimum average signal level that is a reference value representing a possible appearance of the after-image, thereby not attenuating the picture data.

13. The after-image prevention apparatus as claimed in claim 10, wherein the comparator outputs the attenuation coefficient as "1" when a brightness level of the picture data is less than the current average signal level, and wherein the comparator outputs the attenuation coefficient as a value of less than "1" when the brightness level of the picture data is greater than the current average signal level, the attenuation coefficient decreasing with an increase in the difference between the average signal level and the brightness level of the picture data.

14. An after-image prevention apparatus for a plasma display panel, said apparatus to prevent an after-image on the plasma display panel having a plurality of address electrodes and a plurality of scan and sustain electrodes arranged in pairs and in a zigzag pattern, the apparatus comprising:

an area sensor for sensing an area of externally applied picture data and determining whether or not the picture data area is an area predefined for after-image control;

a memory section for storing an average signal level of each cell of the plasma display panel;

an average signal level calculator for calculating an average signal level of each cell until the current frame from the input picture data and an average signal level of each cell until the previous frame as stored in the memory section, when the picture data area is included in the after-image control area;

a comparator for comparing the picture data with the average signal level of each cell output from the average signal level calculator to determine the difference between the picture data and the average signal level and outputting an attenuation coefficient corresponding to the difference when the picture data area is included in the after-image control area, and wherein the comparator outputs the attenuation coefficient as "1" when the picture data area is not included in the after-image control area; and a multiplier for multiplying the picture data by the attenuation coefficient.

15. A plasma display panel apparatus comprising:

a plasma display panel including a plurality of address electrodes and a plurality of scan and sustain electrodes arranged in pairs and in a zigzag pattern;

a controller for processing an externally applied picture signal to output picture data, measuring a load factor of the picture signal, and outputting sustain discharge information corresponding to the measured load factor;

an after-image prevention controller for calculating an average signal level of each cell until the current frame from the picture data output from the controller and an average signal level until the previous frame, comparing the calculated average signal level with the picture data, and multiplying the picture data by an attenuation coefficient corresponding to the difference between the average signal level and the picture data to output correction data;

an address data generator for generating address data corresponding to the correction data and applying the generated address data to the address electrodes of the plasma display panel; and a sustain/scan pulse generator for generating sustain and scan pulses corresponding to the sustain discharge information output from the controller, and applying the generated sustain and scan pulses to the sustain and scan electrodes, respectively.

16. The plasma display panel apparatus as claimed in claim 15, wherein the after-image prevention controller includes:

a memory section for storing the average signal level of each cell of the plasma display panel apparatus;

an average signal level calculator for calculating the current average signal level from the externally applied picture data and the average signal level of each cell until the previous frame stored in the memory section;

a comparator for comparing the picture data with the average signal level of each cell output from the average signal level calculator to determine the difference between the picture data and the average signal level, and outputting an attenuation coefficient corresponding to the difference; and a multiplier for multiplying the picture data by the attenuation coefficient.

17. The plasma display panel apparatus as claimed in claim 16, wherein the comparator outputs the attenuation coefficient as "1" when a brightness level of the picture data is less than the current average signal level, and wherein the comparator outputs the attenuation coefficient as a value of less than "1" when the brightness level of the picture data is greater than the current average signal level, the attenuation coefficient decreasing with an increase in the difference between the average signal level and the brightness level of the picture data.

18. The plasma display panel apparatus as claimed in claim 15, wherein the after-image prevention controller includes:

an area sensor for sensing an area of externally applied picture data and determining whether or not the picture data area is an area predefined for after-image control;

a memory section for storing the average signal level of each cell of the plasma display panel apparatus;

an average signal level calculator for calculating the average signal level of each cell until the current frame from the input picture data and the average signal level of each cell until the previous frame stored in the memory section, when the picture data area is included in the after-image control area;

a comparator for comparing the picture data with the average signal level of each cell output from the average signal level calculator to determine the difference between the picture data and the average signal level and outputting an attenuation coefficient corresponding to the difference, when the picture data area is included in the after-image control area, wherein the comparator outputs the attenuation coefficient as "1" when the picture data area is not included in the after-image control area; and a multiplier for multiplying the picture data by the attenuation coefficient.

19. The plasma display panel apparatus as claimed in claim 18, wherein the comparator outputs the attenuation coefficient as "1" when a brightness level of the picture data is less than the current average signal level, and wherein the comparator outputs the attenuation coefficient as a value of less than "1" when the brightness level of the picture data is greater than the current average signal level, the attenuation coefficient decreasing with an increase in the difference between the average signal level and the brightness level of the picture data.

20. The plasma display panel apparatus as claimed in claim 15, wherein the after-image prevention controller includes:

an area sensor for sensing an area of externally applied picture data and determining whether or not the picture data area is an area predefined for after-image control;

a comparator for receiving an area sensing signal from the area sensor and outputting an attenuation coefficient of "1" for an area other than the predefined after-image control area and an attenuation coefficient having a predetermined value for the after-image control area, wherein the attenuation coefficient is "1" irrespective of the area after a lapse of a predetermined time and where it is a value corresponding to the area sensing signal after another lapse of the predetermined time; and a multiplier for multiplying the picture data by the attenuation coefficient.

* * * * *